United States Patent [19]

Foley

[11] 4,058,304

[45] Nov. 15, 1977

[54] CYLINDER FOLDER

[75] Inventor: Richard Gregory Foley, Dayton, Ohio

[73] Assignee: Harris Corporation, Dayton, Ohio

[21] Appl. No.: 730,439

[22] Filed: Oct. 7, 1976

[51] Int. Cl.[2] ..... B65H 45/20

[52] U.S. Cl. ..... 270/79; 270/69

[58] Field of Search ..... 270/73, 69, 61 F, 79

[56] References Cited

U.S. PATENT DOCUMENTS 1,186,018 6/1916 Meisel ..... 270/73

3,250,528 5/1966 Loase ..... 270/73

*Primary Examiner*—Edgar S. Burr
*Assistant Examiner*—A. Heinz

[57] ABSTRACT

In a cylinder folder for zig-zag folding a flexible web, air is supplied to the region between the web and the cylinder where the web is separated from the cylinder by the web stripper. The air is pressure injected through hollow stripping pins and relieves the vacuum as the web leaves the cylinder, considerably improving the stripping of the web therefrom.

4 Claims, 6 Drawing Figures

CYLINDER FOLDER

CROSS REFERENCE TO RELATED APPLICATIONS

Reference is made to co-pending U.S. application Ser. No. 748,764, filed Dec. 8, 1976.

BACKGROUND OF THE INVENTION

The present invention relates to folding apparatus, and more particularly to cylinder zig-zag folders such as described in U.S. Pat. No. 3,250,528, issued May 10, 1966 and assigned to the assignee of the present invention. Such folders use a pair of driven cylinders which are mounted with their axes of rotation in parallel adjacent relation. The outer cylindrical walls of the cylinders define a nip which receives the web, and gripper and tucker blades in the cylinder walls alternately fold and draw the web from the nip to deposit it in zig-zag fashion in a stack beneath the cylinders on a moving delivery table.

Folding machines such as that described in the above '528 patent have satisfactorily and accurately folded continuous, cross perforated webs at very high speeds. Further, since the principal motions are rotary, with very little reciprocating action, the theoretical maximum speed of operation would seem to be almost without limit. Limitations are imposed, however, by the paper web itself, since at higher speeds it tends to cling to the surfaces of the cylinders. This problem is solved in part by the use of stripping pins, such as the stripping pins 87 shown in the above-noted '528 patent, which help separate the web from the cylinders. However, at higher speeds the tendency of the web to cling to the cylinders can still "bunch" or curl it in the vicinity of the stripping pins.

U.S. Pat. No. 3,980,291, issued Sept. 14, 1976, Ser. No. 564,119, filed Apr. 1, 1975, assigned to the assignee of the present invention, discloses a cylinder folder construction which improves separation of the web from the cylinders with a series of spaced apart shallow recesses formed around each cylinder surface. The recesses have bottoms slightly depressed with respect to the outer cylindrical walls and are separated by relatively narrow ribs which contact the web and form the sides of the recesses. The area of actual contact between the web and the cylinders is thereby substantially reduced, resulting in a considerably reduced tendency for the web to cling to the cylinder surfaces.

Thus, while the above inventions have successfully folded continuous webs at increased speeds, a need still remains to operate such folders at even greater speeds, improving still further the separation of the web from the surfaces of the cylinders as the web is being deposited in the zig-zag stack on the delivery table.

SUMMARY OF THE INVENTION

Briefly, the present invention provides means for supplying air between the web and the cylinders at the region where the web is being stripped from the cylinders. The supply of air is separately provided, and is independent of the surface contours of the cylinders themselves. The air is injected into and at the site of the gap on each cylinder between it and the folded web as the stripping pins engage the folded web and separate it from the cylinders. This injected air, which was not previously present, relieves or breaks the vacuum which tends to form between the web and the cylinder as the stripping pins deflect the web from the cylinder. The air flow may in fact be selected or adjusted to create a slightly positive pressure between the web and the cylinder in this region for removing the web from contact with the cylinder. The cylinder will then tend much less to "overdrive" the web causing it to "bunch" or curl in the vicinity of the stripping pins.

In the preferred embodiment, the stripping pins, which extend from outside the cylinders to the respective surfaces thereof and terminate at pin ends located in the cylinder recesses, are provided with hollow air passageways which open through the ends of the pins in the recesses. A source of compressed air, preferably adjustable, is connected to the pins for supplying air through the pin ends into the cylinder recesses where the web is deflected from the cylinder. A flow of air under pressure is thus introduced into the cylinder surface recesses between the stripping pins, the cylinders, and the folded web to aid the release of the web as it is engaged by the stripping pins and guided away from the cylinders.

It is therefore an object of the present invention to provide an improved cylinder folder construction; a cylinder folder providing a separate flow of air into the region between the cylinders and the web as it is engaged by the stripper means; in which the air is introduced under pressure from an external air supply; and which will provide for substantial increases in operating speeds for such folders in an economical, reliable, and durable fashion.

Other objects and advantages of the invention will be apparent from the following description, the accompanying drawings and the appended claims.

DESCRIPTION OF THE PREFERRED EMBODIMENT

Figure 1:
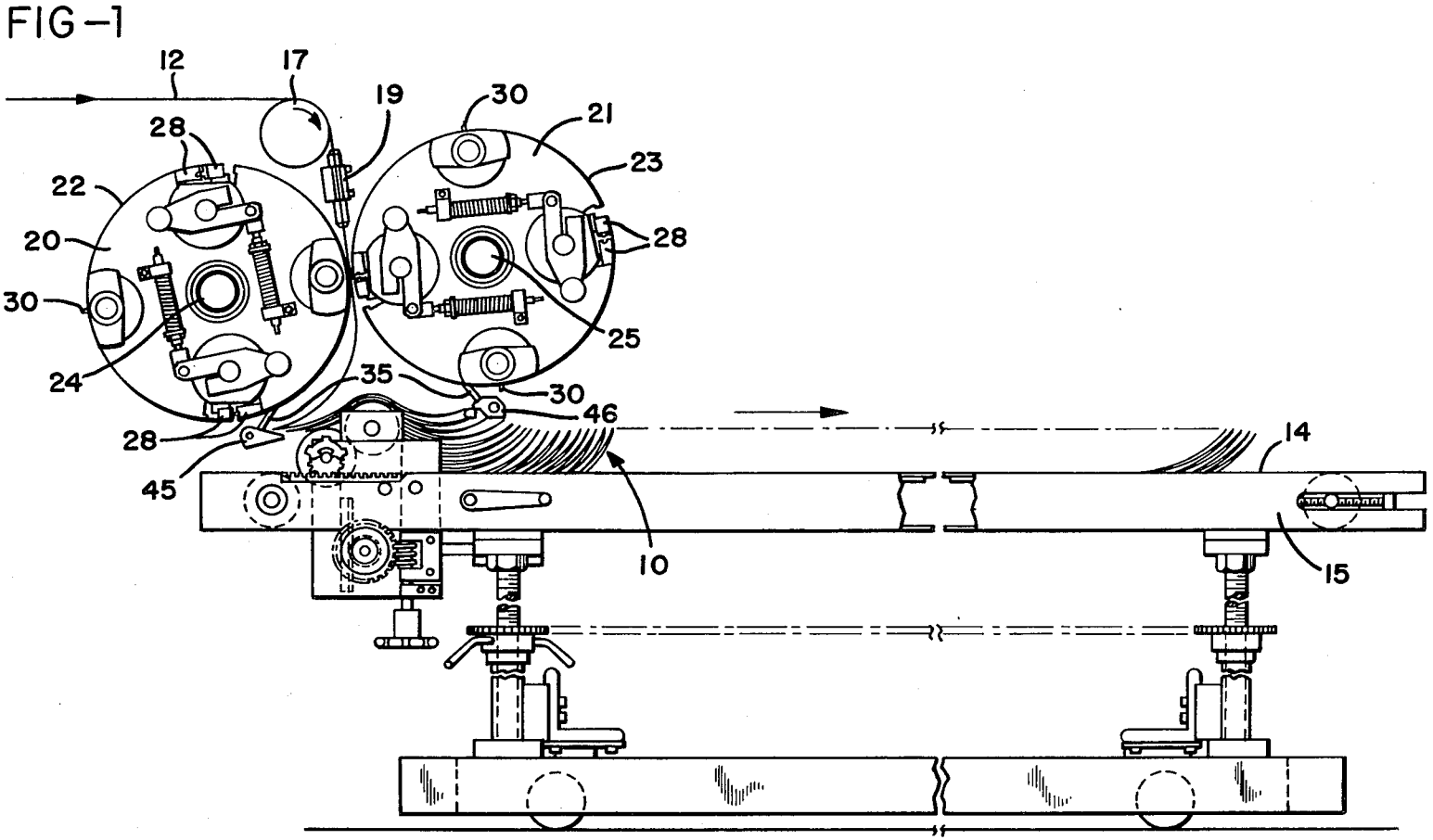
FIG. 1 is a somewhat schematic elevational view of a cylinder web folding apparatus incorporating the present invention.
Figure 2:
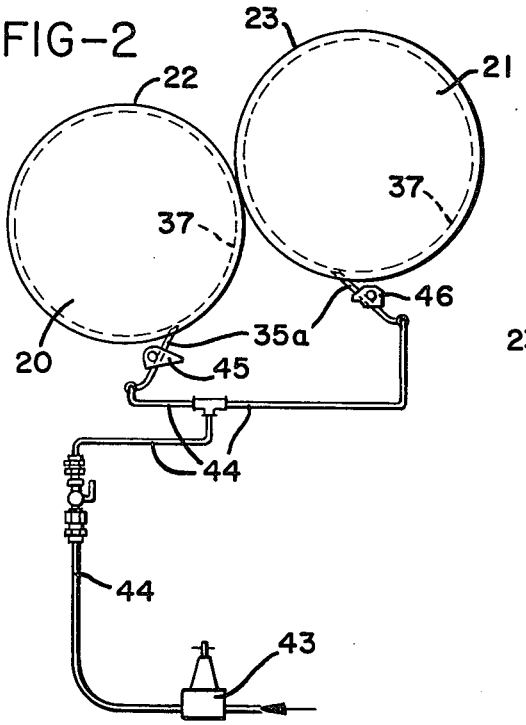
FIG. 2 is a somewhat schematic side view showing the air supply for the stripping pins.

Referring to the drawings, which illustrate a preferred embodiment of the present invention, FIG. 1 shows, in a somewhat schematic manner, the overall construction and arrangement of the folding apparatus and the path of the continuous zig-zag folds 10 of a web 12 as the folds are delivered along the supporting top 14 of a delivery table, generally referred to as 15.

In FIG. 1, the web 12 of paper is shown entering the folding machine in the upper left-hand corner as it is received from a printing press, or the like, and is directed over a power-driven roller 17 downwardly into a feed chute 19. The web may be a single layer or it may be several webs which are overlaid on top of one another, as is commonly used to form multiple-copy business forms. Such webs are also commonly provided with uniformly spaced perforations which lie transversely across the web. The cross perforations allow one form to be easily separated from an adjacent form, and are the lines on which the web is commonly zig-zag folded.

A pair of folding cylinders 20 and 21 having outer cylindrical walls 22 and 23, respectively, are driven and supported on parallel drive shafts 24 and 25, with their axes of rotation in parallel adjacent relation. The drive shafts are supported in the side frames 26 (FIG. 5) of the folding apparatus in conventional fashion. The cylinders 20 and 21 and their cylindrical walls 22 and 23 are counter-rotated at identical peripheral speeds. The cylinders define a nip which receives the web from the feed chute 19 on its way down to the top 14 of the delivery table 15.

Mounted longitudinally and diametrically opposite on each cylinder are pairs of folding jaws or grippers 28 which open and close in known fashion as the cylinders 20 and 21 are counter-rotated by their power source (not shown). Spaced 90° from the grippers 28 are longitudinally disposed pivotable tucker blades 30. The lengthwise mounted grippers 28 and tucker blades 30 are mounted in the walls 22 and 23 of the cylinders with each gripper on one cylinder being arranged in opposed gripping relation with a blade on the other cylinder, and vice versa, in known fashion. As the cylinders rotate, the blades 30 alternately tuck the web 12, preferably at the cross perforations, into the grippers on alternate cylinders, and thus at longitudinally spaced intervals along the web. The grippers 28 then close on the web, and the grippers are controlled in known fashion such that lengths of the web are pulled away from the nip and held by the grippers in contact with portions of the associated outer cylindrical walls 22 or 23. As each gripper 28 rotates to a position opposite table 15, it opens, releasing the web. In this way, the web is held in contact with a portion of the outer cylindrical wall of first one and then the other of the cylinders 20 and 21, and then released in this alternating fashion by the grippers 28, to form the zig-zag folds 10 of the web 12.

In operation, the grippers open slightly before they are rotated to positions opposite the delivery table 15, so that as the web folds engage a series of stripping pins 35 the pins assist in removing the web from contact with the outer cylindrical walls 22 and 23. The stripping pins 35 extend from outside the cylinders into recesses 37 in the outer cylindrical walls 22 and 23, and are positioned and operative to guide the folded web from the grippers and cylinders.

Figure 6:
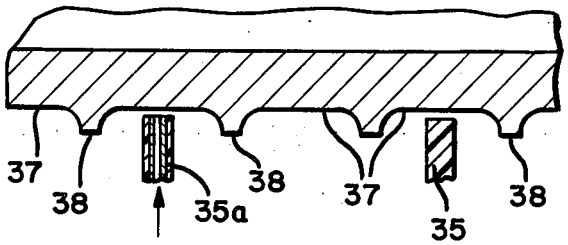
FIG. 6 is a cross sectional view on line 6—6 of FIG. 3.

The recesses 37 form a series of spaced apart shallow recesses opening outwardly in a circumferential direction around each cylinder, and have bottoms slightly depressed with respect to the outer cylindrical walls 22 and 23. The recesses are separated by relatively narrow ribs 38 which contact the web 12 and form the sides of the recesses 37. As may be seen in FIG. 6, the area of contact between the outer cylindrical walls 22 and 23 and the web 12 is thus limited to the small area of the ribs 38. This limited area of contact reduces the tendency of the web to cling to the cylinders after the web is released by the gripper 28 and engaged by the stripping pins 35.

Figure 3:
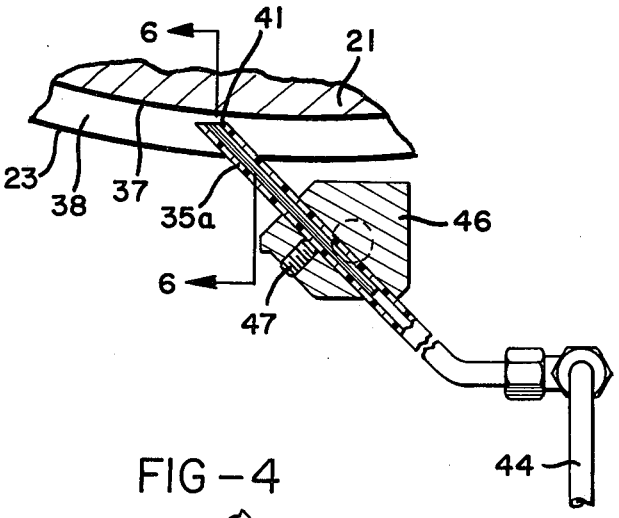
FIG. 3 is a cross sectional fragmentary view of one of the stripping pins and its associated cylinder and air supply line.
Figure 4:
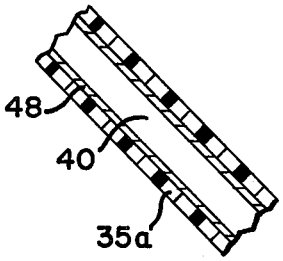
FIG. 4 is a fragmentary cross sectional view of one of the hollow stripping pins.

Although the broad recesses 37 and narrow ribs 38 facilitate release of the web 12 from the outer cylindrical walls 22 and 23, it has been found that at higher operating speeds a more satisfactory zig-zag folded web can be provided if the stripping pins 35 are further aided in removing the web 12 from the cylinders. Thus, as illustrated in FIGS. 2–6, selected stripping pins **35*a* have hollow cores 40. The hollow cores provide air passages through the stripping pins which open through the pin ends 41 in the cylinder recesses 37. The hollow pins 35*a*, which may be formed of plastic tubing as illustrated in FIGS. 3 and 4, are connected through a regulator 43 and suitable air supply lines 44 to a conventional source of pressurized or compressed air (not shown). The regulated compressed air, which in a typical embodiment is regulated to 40 psi, then flows into the pin air passages 40 for discharge through the pin ends 41 into the cylinder recesses 37 between the web 12 and the cylinder wall. This introduces a flow of air under pressure into the cylinder recesses 37 as the folded web is released by the grippers 28 and guided from the cylinders by the stripping pins 35**. This supply of air into the region between the web, the cylinders, and the stripping pins aids the release of the web as it is engaged by the stripping pins.

The stripping pins are supported in position adjacent the cylinders by stripping pin support bars 45 and 46. The stripping pin positions in the bars 45 and 46 are individually adjustable by set screws 47 (FIG. 3). The hollow stripping pins **35*a* are therefore reinforced with a short length of metallic tubing 48**, which also serves as a metering orifice to regulate the flow of air therethrough.

Figure 5:
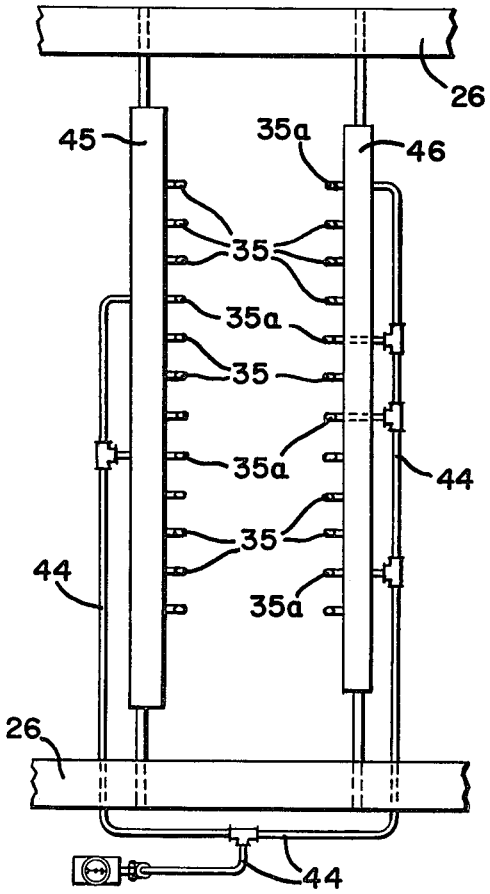
FIG. 5 is a plan view of the pins, pin supports, and air supply as shown in FIG. 2.

In the preferred embodiment, it has been found that it is not neceseary to supply air through all of the stripping pins 35. Rather, according to the size and speed of the folding cylinders 20 and 21 and the nature of the web 12, it is often satisfactory to supply air through only selected ones of the stripping pins 35. Thus, as illustrated in FIG. 5, where each folding cylinder has 12 recesses 37, only the fifth and ninth stripping pins for the left hand cylinder 20, and the second, sixth, eighth, and twelfth stripping pins for the right hand cylinder 21, are hollow stripping pins **35*a*. Clearly, the number of such pins 35*a*** and their positions may be varied by practitioners skilled in the art, according to the teachings of this invention and in response to the particular application at hand. For example, the pins may also be provided individually with their own regulators and/or shut-off valves, as may be appropriate.

As may be seen, therefore, the present invention provides numerous advantages. Principally, the present invention provides for substantial increases in the operating speeds of cylinder folders, with inexpensive and easily provided improvements thereto. As shown and described, air is injected from a source of compressed air into selected recesses in the folding cylinder surfaces. The air is supplied through hollow stripping pins, aiding the release of the web from the cylinder as it is engaged by the stripping pins. The invention is thus inexpensive, easy to fabricate, and readily adaptable to many of the most popular existing cylinder folder configurations.

Other variations, within the scope of the present specification and claims, will of course occur to those skilled in this art after reading the present disclosure. For example, while narrow orifice pins supplied with air at 40 psi have been described in one preferred embodiment, it has been found that the velocity and volume of the discharged air are usually two of the more important parameters. Thus, a lower pressure (although still "compressed") air source, supplied through appropriately larger nozzles, is also clearly within the scope of the present invention.

Thus, while the form of apparatus herein described constitutes a preferred embodiment of this invention, it is to be understood that the invention is not limited to this precise form of apparatus, and that changes may be made therein without departing from the scope of the invention.

What is claimed is:

1. In apparatus for zig-zag folding a flexible web, including a pair of driven cylinders disposed in parallel adjacent relation and adapted to receive the web therebetween, cooperating means on each cylinder for folding the web alternately on alternate cylinders at longitudinally spaced intervals along the web in response to rotation of the cylinders, and stripper means for each cylinder for engaging a folded portion of the web to deflect and guide the folded web portion from each respective cylinder, the web forming a gap between itself and the cylinder as it is stripped therefrom, the improvement comprising:

stationary means disposed adjacent the circumferential walls of the cylinders and independent thereof for injecting a flow of air under pressure into the gap formed between a folded web portion and a respective cylinder as the stripper means engage and separate the folded web from the cylinders, for aiding the release of the web.

2. The device of claim 1 wherein the stripper means further comprise stripping fingers extending from outside the cylinders to the respective circumferential surfaces thereof and ending thereadjacent, at least one of said fingers including means forming an air passage therethrough opening through an end thereof adjacent the respective cylinder surface.

3. The device of claim 2 wherein said means for injecting said flow of air under pressure into the gap comprises a source of compressed air, and means for supplying the compressed air into said finger air passages for discharge through said ends thereof into the gap between the cylinders, and the folded web.

4. In a high speed cylinder folder for folding a continuous web in zig-zag fashion, the folder including a pair of driven cylinders having outer cylindrical walls and being mounted with their axes of rotation in parallel adjacent relation, the walls defining a nip adapted to receive the web therebetween, grippers and tucker blades mounted lengthwise in the walls of each cylinder, each gripper on one cylinder being arranged in opposed cooperating relation with a blade on the other cylinder, and vice versa, whereby the blades alternately tuck the web into the grippers on alternate cylinders at longitudinally spaced intervals along the web in response to rotation of the cylinders, the grippers being controlled such that lengths of the web are pulled away from the nip and held by the grippers in contact with portions of the associated outer cylindrical walls of first one and then the other of the cylinders before release of the grippers, the portions of the outer walls having formed therein a series of spaced apart shallow recesses opening outwardly in a circumferential direction around each cylinder and having bottoms slightly depressed with respect to the outer cylindrical walls, the recesses being separated by relatively narrow ribs which are adapted to contact the web and which form the sides of the recesses, and stripping pins extending from outside the cylinders into the cylinder recesses and having ends therein, the stripping pins being positioned and operative to guide the folded web from the grippers and cylinders upon release of the grippers, the improvement comprising:

a. a source of compressed air, b. means providing air passages through selected stripping pins, said passages opening through the ends of the pins in the recesses, and c. means for supplying the compressed air into said pin air passages for discharge through the ends thereof into the cylinder recesses between the web and the cylinder walls for introducing a flow of air under pressure into the recesses as the folded web is released by the grippers and is guided away from the cylinders by the stripping pins, for aiding the release of the web as it is engaged by the stripping pins.

* * * * *